US009512800B2

(12) United States Patent
Smith et al.

(10) Patent No.: US 9,512,800 B2
(45) Date of Patent: Dec. 6, 2016

(54) VALVE ASSEMBLY

(75) Inventors: Kenneth L. Smith, Rainham (GB); Richard A. Judge, Gillingham (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 481 days.

(21) Appl. No.: 13/976,167

(22) PCT Filed: Nov. 16, 2011

(86) PCT No.: PCT/EP2011/070211

§ 371 (c)(1),
(2), (4) Date: Jun. 26, 2013

(87) PCT Pub. No.: WO2012/095204

PCT Pub. Date: Jul. 19, 2012

(65) Prior Publication Data

US 2013/0284275 A1 Oct. 31, 2013

(30) Foreign Application Priority Data

Jan. 12, 2011 (GB) ..... 1100480.1

(51) Int. Cl.
*F02M 59/34* (2006.01)
*F02M 59/36* (2006.01)
(Continued)

(52) U.S. Cl.
CPC ..... *F02D 41/30* (2013.01); *F02D 41/3845* (2013.01); *F02M 59/34* (2013.01);
(Continued)

(58) Field of Classification Search
CPC .. F02M 69/54; F02M 63/0225; F02M 69/26; F02M 59/366; F02M 59/34; F02M 59/36; F02M 36/00; F02M 63/02; F02M 57/026; F02M 63/0007; F02M 63/0005; F02M 47/027; F02M 57/025; F02D 41/38; F02D 41/3845; F02D 2250/31
USPC ..... 123/457, 446, 454, 458, 459
See application file for complete search history.

(56) References Cited

U.S. PATENT DOCUMENTS 3,779,225 A * 12/1973 Watson et al. ..... 123/449
6,019,091 A * 2/2000 Spoolstra ..... 123/496
(Continued)

FOREIGN PATENT DOCUMENTS

CN 101063434 A 10/2007
CN 101896717 A 11/2011
(Continued)

OTHER PUBLICATIONS

International Search Report dated Feb. 24, 2012.

*Primary Examiner* — Hai Huynh
*Assistant Examiner* — Raza Najmuddin
(74) *Attorney, Agent, or Firm* — Joshua M. Haines

(57) ABSTRACT

A valve assembly suitable for use as an inlet metering valve of a fuel injection system comprises an inlet opening, an outlet aperture, and a valve element arranged to control fluid flow between the inlet opening and the outlet aperture. The valve element is moveable in response to an applied control signal to a closed position and to a fully-open position, and is biased to return to a rest position when the control signal is absent. When the valve element is in the rest position, fluid flow between the inlet opening and the outlet aperture is permitted at a relatively low rate. When the valve element is in the closed position, fluid flow between the inlet opening and the outlet aperture is substantially prevented. When the valve element is in the fully-open position, fluid flow between the inlet opening and the outlet aperture is permitted at a relatively high rate.

10 Claims, 5 Drawing Sheets

(51) Int. Cl.

| | |
|---|---|
| ***F02D 41/30*** | (2006.01) |
| ***F02D 41/38*** | (2006.01) |
| ***F02M 63/00*** | (2006.01) |
| ***F02M 63/02*** | (2006.01) |
| *F02D 41/22* | (2006.01) |

(52) U.S. Cl.

CPC ..... *F02M 59/366* (2013.01); *F02M 63/004* (2013.01); *F02M 63/0017* (2013.01); *F02M 63/0043* (2013.01); *F02M 63/0056* (2013.01); *F02M 63/0215* (2013.01); *F02D 2041/227* (2013.01); *F02M 2200/18* (2013.01); *F02M 2200/28* (2013.01); *Y10T 137/0396* (2015.04); *Y10T 137/86027* (2015.04)

(56) References Cited

U.S. PATENT DOCUMENTS

| | | | | |
|---|---|---|---|---|
| 6,158,419 | A * | 12/2000 | Jett et al. | 123/446 |
| 7,428,894 | B2 | 9/2008 | Kikutani et al. | |
| 8,240,291 | B2 * | 8/2012 | Ibrahim et al. | 123/458 |
| 2010/0288233 | A1 | 11/2010 | Wieland et al. | |
| 2011/0192377 | A1 | 8/2011 | Boecking | |

FOREIGN PATENT DOCUMENTS

| | | | |
|---|---|---|---|
| DE | 10247436 | * | 5/2003 |
| DE | 10247436 | A1 | 5/2003 |
| WO | 2010/020464 | A1 | 2/2010 |
| WO | 2010/049203 | A1 | 5/2010 |

* cited by examiner

VALVE ASSEMBLY

CROSS REFERENCE TO RELATED APPLICATIONS

This application is a national stage application under 35 U.S.C. 371 of PCT Application No. PCT/EP2011/070211 having an international filing date of 16 Nov. 2011, which designated the United States, which PCT application claimed the benefit of Great Britain Application No. 1100480.1 filed 12 Jan. 2011, the entire disclosure of each of which are hereby incorporated herein by reference.

FIELD OF THE INVENTION

This invention relates to a valve assembly for controlling the flow of a fluid. In particular, but not exclusively, the invention relates to a valve assembly suitable for use as an inlet metering valve for a fuel rail inlet of a high-pressure fuel injection system.

BACKGROUND TO THE INVENTION

FIG. 1 of the accompanying drawings is a schematic diagram of a conventional fuel injection system 10 for an internal combustion engine.

The fuel injection system 10 comprises a plurality of fuel injectors 12. Each injector 12 is arranged to deliver an atomised spray of high-pressure fuel to a respective combustion chamber (not shown) of the engine. The injectors 12 receive fuel at high pressure from an accumulator volume or rail 14, by way of high-pressure supply lines 16. The rail 14 comprises a reservoir for high-pressure fuel.

Delivery of fuel from the injectors 12 is controlled by an electronic control unit 18. When a fuel injection from one of the injectors 12 is required, the electronic control unit 18 sends an actuation signal to the injector 12, which causes actuation of a delivery valve (not shown) of the injector 12.

Fuel is pumped to the rail 14 from a storage tank 20 by a fuel pump assembly 22. The fuel pump assembly 22 includes a low-pressure transfer pump 24, which serves to convey fuel from the tank 20 to the pump assembly 22, and a high-pressure pump 26 which elevates the pressure of the fuel to the injection pressure, typically of the order of 2000 bar. Fuel is conveyed from the tank 20 to the pump assembly 22 by way of a low-pressure fuel line 28, and from the pump assembly 22 to the rail by way of a high-pressure fuel line 30.

An inlet metering valve 32, under the control of the engine control unit 18, is provided between the transfer pump 24 and the high-pressure pump 26 of the pump assembly 22. The inlet metering valve 32 determines how much fuel reaches the high-pressure pump 26, for subsequent pressurisation and delivery to the rail 14.

The fuel pressure in the rail 14 is regulated to a target value by the electronic control unit 18 in the following way. The engine control unit 18 determines the fuel pressure in the rail by means of a rail pressure sensor 34. When the rail pressure is less than the target value, the engine control unit 18 opens the inlet metering valve 32 so that the high-pressure pump 26 delivers fuel at high pressure to the rail 14. When the rail pressure is more than the target value, the engine control unit 18 closes the inlet metering valve 32 so that the fuel pressure in the rail 14 can decay as fuel is delivered through the injectors 12.

In practice, the inlet metering valve 32 is configured to allow a variable flow from the transfer pump 24 to the high-pressure pump 26 within the range from fully-closed to fully-open, so as to permit accurate control of the rail pressure. In operation, the electronic control unit 18 selects the appropriate flow rate through the inlet metering valve 32 by adjusting the magnitude or other property of the signal supplied to an actuator of the inlet metering valve 32.

When the inlet metering valve 32 is fully open, the rate of increase of the rail pressure is maximised. To reduce the rate of increase of the rail pressure, the flow through the inlet metering valve 32 is reduced to throttle fuel flow to the high-pressure pump 26. In this way, accurate control of the pressure in the rail 14 can be achieved. For example, when pressurising the rail 14, the flow through the inlet metering valve 32 can be gradually reduced as the rail pressure approaches its target value so as to avoid the rail pressure overshooting the desired target value. Also, in steady-state engine operating conditions, the inlet metering valve 32 can be set to an appropriate level so that the fuel delivered to the high-pressure pump 26 equals the amount delivered to the injectors 12 plus any internal leakages, in order to maintain a steady fuel rail pressure.

One kind of inlet metering valve 32 known in the art is of the normally-closed type, in which an electrical signal must be supplied in order to allow fuel flow from the transfer pump 24 to the high-pressure pump 26 through the inlet metering valve 32. In the absence of an electrical signal from the engine control unit 18, the inlet metering valve 32 remains closed, so that no fuel reaches the high-pressure pump 26 and so there is no fuel delivery to the rail 14.

Accordingly, in the event of a system failure that causes no signal to be supplied to the inlet metering valve, an inlet metering valve 32 of the normally-closed type will cause the non-delivery of fuel to the rail 14, and hence the supply of fuel to the injectors 12 will cease. This will result in the engine stopping, or failing to start.

In some applications, for example in marine and industrial applications, stopping of the engine or its failure to start is particularly undesirable.

This problem can be addressed by the use of another kind of known inlet metering valve 32, of the normally-open type. In an arrangement with a normally-open inlet metering valve 32, an electrical signal must be supplied to the valve 32 in order to reduce or to completely stop the flow of fuel from the transfer pump 24 to the high-pressure pump 26. In the absence of an electrical signal from the engine control unit 18, the inlet metering valve 32 rests in its fully-open position and the fuel pressure in the rail 14 increases when the transfer pump 24 and high-pressure pump 26 are operational.

In this arrangement, a system failure that results in no signal being supplied to the inlet metering valve 32 will not cause the cessation of fuel delivery to the rail 14. Instead, because the inlet metering valve 32 will remain fully open, fuel will be continuously delivered to the rail 14 so that the engine can continue to operate.

It will be appreciated that, in this failure mode, the fuel pressure 14 in the rail can no longer be moderated by the inlet metering valve 32 and, when the rate of fuel injection through the injectors 12 is insufficient to relieve the fuel pressure, the rail pressure could rise to damaging levels. To avoid the risk of damage to the system as a result of overpressure in the rail 14. a pressure-limiting valve 36 is provided. The pressure-limiting valve 36 opens when the rail pressure exceeds a pre-determined threshold level, to provide a path for the flow of fuel from the rail 14 to the low-pressure tank 20, via a return line 38. In this way, the rise of fuel pressure in the system to an unacceptable level can be avoided. However, the addition of a pressure-limiting valve 36 and the associated fuel return line 38 undesirably increases the cost and complexity of the system.

DE10247436 discloses embodiments of normally open and normally closed metering valves. Against this background, it would be desirable to provide a less complex fuel injection system that allows an engine to continue to operate whilst preventing overpressurisation of the fuel in the system.

SUMMARY OF THE INVENTION

According to a first aspect of the present invention, there is provided a valve assembly comprising inlet means, outlet means, and a valve element arranged to control fluid flow between the inlet means and the outlet means. The valve element is moveable in response to an applied control signal to a closed position and to a fully-open position, and is biased to return to a rest position when the control signal is absent.

When the valve element is in the rest position, fluid flow between the inlet means and the outlet means is permitted at a relatively low rate. When the valve element is in the closed position, fluid flow between the inlet means and the outlet means is substantially prevented. When the valve element is in the fully-open position, fluid flow between the inlet means and the outlet means is permitted at a relatively high rate.

It is a particular advantage of the present invention that the valve assembly allows flow between the inlet means and the outlet means at a relatively low or restricted rate when no control signal is present. For example, when the valve assembly is used as an inlet metering valve in a fuel injection system, in the event of a failure that leads to the absence of the control signal, fuel can still flow through the valve assembly to allow operation of the engine. However, because the flow through the valve assembly occurs at a relatively low rate, the risk of overpressurisation of the fuel injection system, and in particular the fuel rail, is reduced.

It is a further advantage of the present invention that flow through the valve assembly can be stopped when desired, by setting the valve element into the closed position so as to substantially prevent flow between the inlet means and the outlet means. It will be appreciated that, depending on the configuration of the valve assembly and the manufacturing tolerances, in some embodiments a small or negligible leakage flow may still occur when the valve element is in the closed position, and the term 'substantially prevented' should be construed accordingly.

Movement of the valve element may be controlled by an actuator, such as a solenoid actuator that receives the control signal. The valve element may be moveable into the closed position on application of a first control signal and towards the fully-open position on application of a second control signal. In one embodiment, the magnitude of the second control signal is greater than the magnitude of the first control signal. The magnitude of the control signal may represent the voltage or current of the control signal. In another embodiment, the control signal is a digital signal that relates to a position of the valve element.

The closed position is preferably intermediate the rest position and the fully-open position. Conveniently, the valve element may be moveable linearly between the rest, closed and fully-open positions.

In one embodiment, the valve assembly further comprises a valve body having a bore, and the valve element is received within the bore. The valve element may be slidably received within the bore for linear movement between the rest, closed and fully-open positions.

The inlet means may comprise at least one inlet opening in the valve body, in which case the valve element may be configured to occlude the inlet opening when in the closed position.

The valve element may comprise at least one bypass orifice that communicates with the outlet means, arranged such that the bypass orifice overlaps with the inlet opening to allow fuel to flow at the relatively low rate when the valve element is in the rest position. Said another way, in the rest position, the bypass orifice communicates with the inlet means.

The valve element may comprise at least one metering orifice that partially or fully overlaps with the inlet opening to allow fuel to flow at the relatively high rate when the valve element is in the fully-open position.

When the valve element comprises bypass and metering orifices, the total flow area available through the bypass orifice or orifices is preferably less than the total flow area available through the metering orifice or orifices.

The valve assembly may further comprise an adjustable stop that defines the relative location of the valve element when in the fully-open position, with respect to the valve body. The stop may comprise an end stop, for example in the form of an insert that is received in an end of the bore of the valve body. In this way, the maximum flow rate through the valve assembly can be accurately set during manufacture or servicing.

Advantageously, the valve element is moveable to at least one partially-open position in which fluid flow between the inlet means and the outlet means occurs at a reduced rate compared to the fully-open position. Preferably, the valve element is moveable to a plurality of partially-open positions between the closed position and the fully open position to selectively vary the fluid flow rate between the inlet means and the outlet means from approximately zero to the relatively high rate, depending on the applied control signal. In these ways, an appropriate intermediate fluid flow through the valve assembly can be selected.

In a second aspect, the present invention extends to an inlet metering valve for a fuel injection system, comprising a valve assembly according to the first aspect of the invention.

In a third aspect, the invention resides in a fuel injection system for an internal combustion engine, comprising an inlet metering valve according to the second aspect of the invention, a transfer pump for delivering fuel to the inlet means of the valve assembly, a high-pressure pump arranged to receive fuel from the outlet means of the valve assembly and to deliver the fuel at high pressure to a fuel rail, and an electronic control unit for providing the control signal to the valve assembly.

In a fourth aspect, the invention extends to a method for controlling fuel pressure in a fuel injection system of an internal combustion engine, the fuel injection system comprising a high-pressure pump, an inlet metering valve for controlling fuel supply to the high-pressure pump, and an electronic control unit for providing a control signal to the inlet metering valve. The inlet metering valve is arranged to allow a restricted flow of fuel therethrough when no control signal is provided. The method comprises closing the inlet metering valve when a control signal of relatively low magnitude is provided, and fully opening the inlet metering valve when a control signal of relatively high magnitude is provided.

By virtue of this method, a failure that results in no control signal being provided to the inlet metering valve does not prevent fuel from reaching the cylinders of the engine, so that the engine can continue to operate in a reduced-functionality mode.

The method may further comprise partially opening the inlet metering valve when a control signal of intermediate magnitude is provided. In this way, complete control of the fuel flow to the high-pressure pump can be achieved, to allow precise control of the fuel pressure in the rail.

Optionally, the inlet metering valve may comprise a valve assembly according to the first aspect of the invention.

Preferred and/or optional features of each of the aspects of the invention may be included, alone or in appropriate combination, in the other aspects of the invention also.

BRIEF DESCRIPTION OF THE DRAWINGS

Embodiments of the present invention will now be described, by way of example only, with reference to the remaining accompanying drawings, in which like reference numerals are used for like parts, and in which.

DETAILED DESCRIPTION OF EMBODIMENTS OF THE INVENTION

Figure 2:
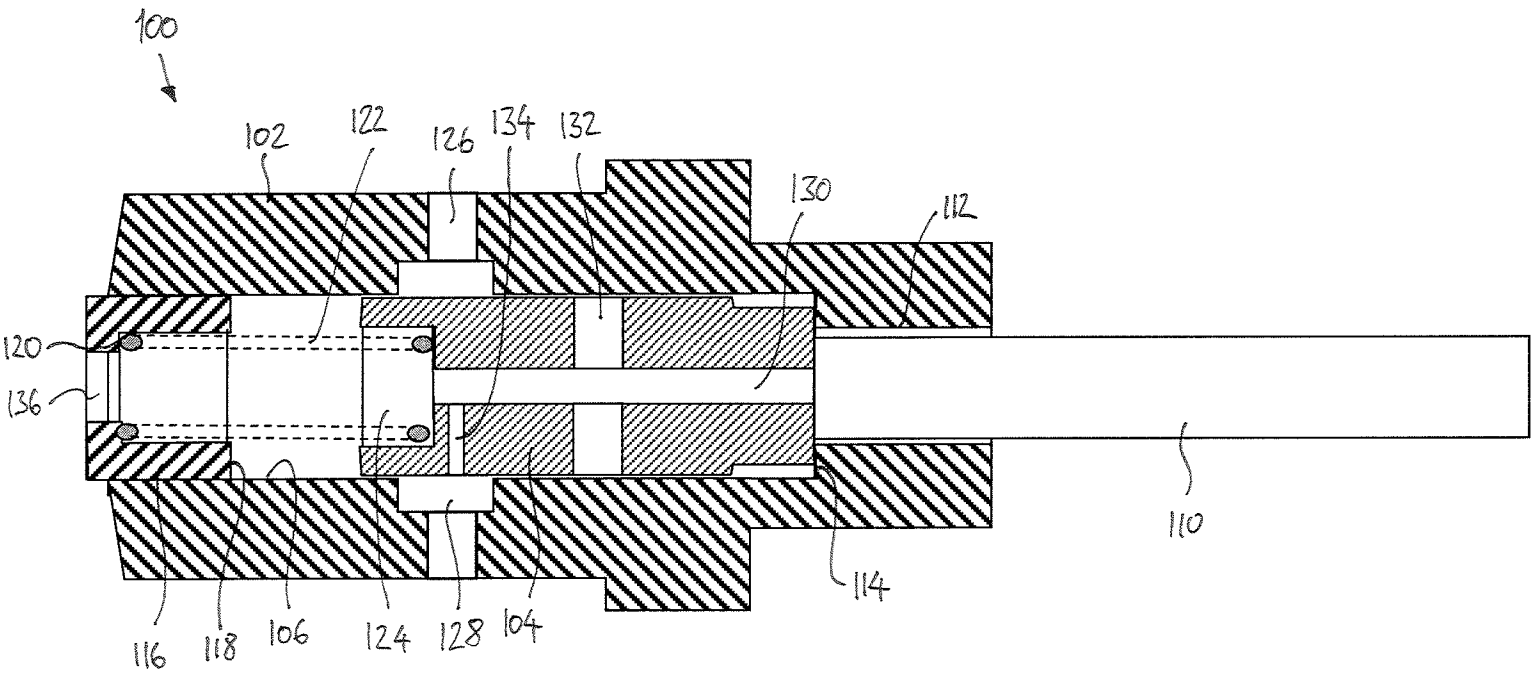
FIG. 2 is a schematic cross-sectional diagram showing a valve assembly according to an embodiment of the present invention.

Referring first to FIG. 2, in one embodiment of the invention a valve assembly 100 is provided. The valve assembly 100 is suitable for use as an inlet metering valve to control the fuel supply to a high-pressure pump of a fuel injection system and, for ease of understanding, reference to the use of the valve assembly 100 in such a fuel injection system will be made in the following description. However, it should be appreciated that the valve assembly 100 is not limited to this application, and could be used in many other applications.

The valve assembly 100 includes a valve body 102 of generally tubular form, and a generally cylindrical valve element 104. The valve body 102 includes an axial valve bore 106, and the valve element 104 is slidably received within the valve bore 106.

Movement of the valve element 104 within the bore 106 is controlled by a control rod 110 that projects out of one end of the bore 106. The control rod 110 may be attached to the valve element 104, or may be formed integrally with the valve element 104. The control rod 110 is caused to move in a linear manner, parallel to the axis of the bore 106, by a linear motion actuator (not shown), such as a solenoid actuator, linear stepper motor, voice coil actuator, piezoelectric actuator or any other suitable actuator, in response to a control signal from an electronic control unit (not shown in FIG. 2) of the fuel injection system. The control rod 110, and hence the valve element 104, moves to the left in FIG. 2 when a signal is applied to energise the actuator.

The linear displacement of the control rod 110 is determined by a variable property of the signal, such as the magnitude of the voltage or the current of the signal. Accordingly, the position of the valve element 104 with respect to the valve body 102 is controllable by the electronic control unit.

The control rod 110 is guided within a reduced-diameter end portion 112 of the bore 106. The end portion 112 defines an internal shoulder 114 within the bore 106 that provides a first end stop for movement of the valve element 104 towards the right in FIG. 2.

A generally tubular sleeve insert 116 is received in the end of the bore 106 opposite the shoulder 114. An end face 118 of the sleeve insert 116 provides a second end stop for movement of the valve element 104 towards the left in FIG. 2. The sleeve insert 116 includes an inwardly-directed flange that defines an abutment face 120 of the sleeve insert 116.

A biasing spring 122 is provided to bias the valve element 104 towards the shoulder 114 (i.e. towards the right in FIG. 2). The sleeve insert 116 receives an end portion of the spring 122, so that the end of the spring 122 acts against the abutment face 120. An opposite end portion of the spring 122 is received within a recess 124 provided in the end of the valve element 104 opposite the control rod 110.

The valve body 102 comprises inlet means in the form of radial inlet passages 126 that communicate with an annular inlet chamber 128 that is recessed into the wall of the bore 106, approximately mid-way along its length. Two inlet passages 126 are shown in FIG. 2, but it will be appreciated that fewer or more inlet passages 126 could be provided. In use, the inlet passages 126 are supplied with fuel, for example from a transfer pump (not shown) of the fuel injection system.

The valve element 104 includes an axial flow passage 130 that extends centrally through the valve element 104 to communicate with the recess 124. A plurality of metering orifices 132 extend radially from the axial flow passage 130 to the outer surface of the valve element 104. The metering orifices 132 are located approximately mid-way along the length of the valve element. Two metering orifices 132 are shown in FIG. 2, although it will be appreciated that fewer or more metering orifices 132 could be provided.

The valve element 104 also includes a bypass orifice 134 that extends radially from the axial flow passage 130 to the outer surface of the valve element 104. The bypass orifice 134 has a relatively small diameter compared to the metering orifices 132, and is located between the metering orifices 132 and the recess 124 in the end of the valve element 104. When the valve element 104 abuts the shoulder 114 of the valve body, the bypass orifice 134 lines up with and communicates with the inlet chamber 128.

In FIG. 2, only one bypass orifice 134 is shown, although more than one bypass orifice 134 could be provided. However, the total flow area available through the or each bypass orifice 134 is less than the total flow area available through the metering orifices 132.

An outlet means of the valve assembly 100 comprises an outlet aperture 136 in the end of the sleeve insert 116.

As will now be described with reference to FIGS. 3(*a*) to 3(*c*), flow through the valve assembly 100 is controlled by the position of the valve element 104 with respect to the valve body 102.

Figure 3A:
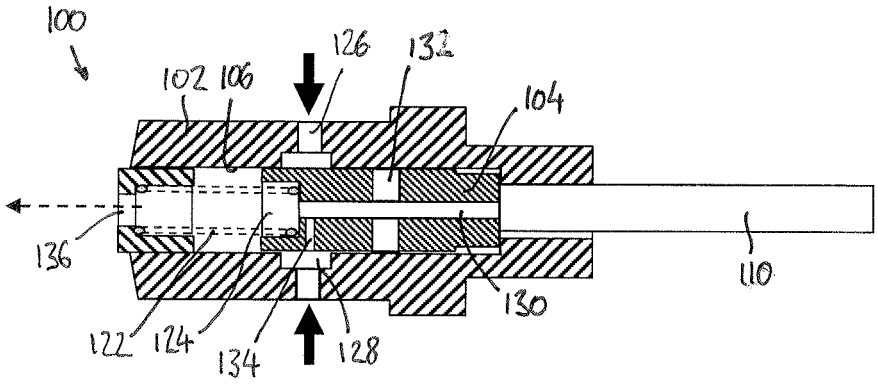
FIGS. 3(*a*), 3(*b*) and 3(*c*) show the valve assembly of FIG. 2 in first, second and third operating conditions, respectively.
Figure 3B:
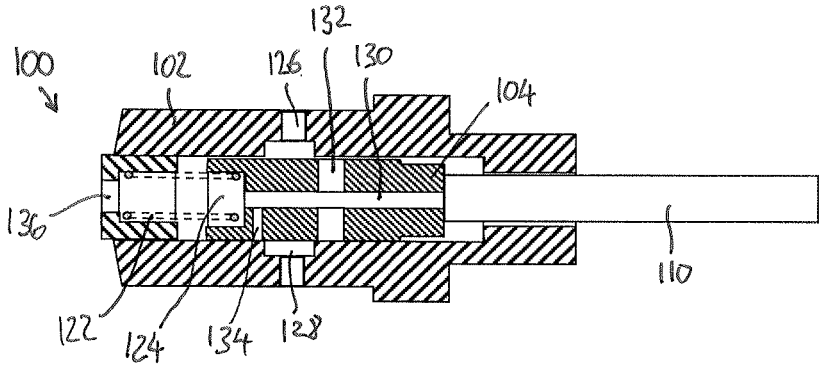
Figure 3C:
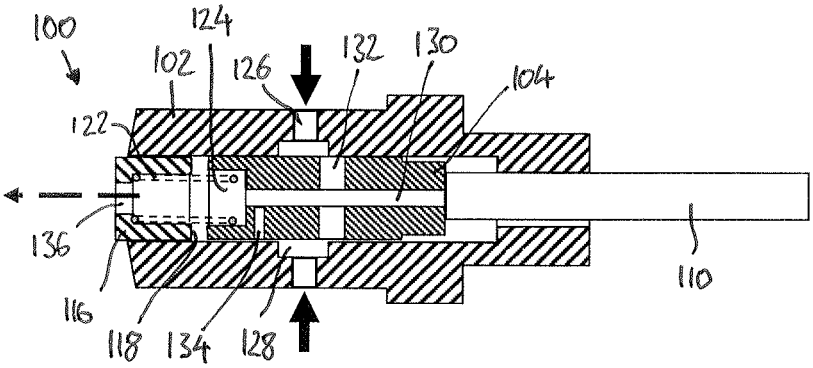

FIG. 3(*a*) shows the valve assembly 100 in a first mode of operation, in which the valve element 104 abuts the shoulder 114. This position is referred to hereafter as the 'rest position' of the valve element 104, since the valve element 104 will adopt this position under the influence of the biasing spring 122 when no signal is applied to the actuator. As noted above, when the valve element 104 is in the rest position, the bypass orifice 134 communicates with the inlet passages 126, via the inlet chamber 128.

Accordingly, in the rest position shown in FIG. 3(*a*), fluid flow through the valve assembly 100 can take place from the inlet passages 126 to the outlet aperture 136 through the bypass orifice 134, and then through the axial passage 130, the recess 124, the bore 106 and the sleeve insert 116. Since the bypass orifice 134 has a relatively small diameter, it acts as a throttle to limit the flow rate through the valve assembly 100.

FIG. 3(*b*) shows the valve assembly 100 in a second mode of operation. In this case, the actuator is energised by a control signal to an extent that is sufficient to move the valve element 104 away from its rest position, into a position where the inlet chamber 128 is closed off by the outer surface of the valve element 104. The position of the valve element 104 in FIG. 3(*b*) will be referred to hereafter as the 'closed position'.

It will be appreciated that, in the illustrated embodiment, the distance between the bypass orifice 134 and the metering orifices 132 is greater than the width of the inlet chamber 128 in the axial direction so that, in the closed position, the inlet chamber 128 communicates with neither the bypass orifice 134 nor the metering orifices 132.

Since the valve element 104 is a close sliding fit within the bore 106 of the valve body 102, there is no significant flow of fuel to the outlet aperture 136 when the valve assembly 100 is in the closed position (although it will be appreciated that a minor flow may be present due to leakage between the valve element 104 and the bore 106). Accordingly, in the closed position, flow through the valve assembly 100 is effectively or substantially prevented, save for some minor leakage flow. In other words, flow through the normal flow passages of the valve assembly 100 is not possible in the closed position.

FIG. 3(*c*) shows the valve assembly 100 in a third mode of operation. In this case, the energisation level of the actuator is increased compared to the second mode of operation, so that the valve element 104 moves further towards the outlet aperture 136. Now, the metering orifices partially overlap with the inlet chamber 128, and the position of the valve element 104 will be referred to hereafter as a 'partially-open' position.

In the partially-open position shown in FIG. 3(*c*), fluid flow through the valve assembly 100 can take place from the inlet passages 126 to the outlet aperture 136 through the metering orifices 132, and then through the axial passage 130, the recess 124, the bore 106 and the sleeve insert 116. The rate of flow is dependent on the extent to which the metering orifices 132 overlap with the inlet chamber 128, and hence on the linear position of the valve element 104.

In a special case of the third mode of operation (not illustrated), when the actuator is energised to a greater extend than illustrated in FIG. 3(*c*), the valve element 104 abuts the end face 118 of the sleeve insert 116. In this case, the maximum possible overlap between the metering orifices 132 and the inlet chamber 128 is achieved. This position of the valve element 104 will be referred to hereafter as the 'fully-open position'.

It will be appreciated that, in the fully-open position, the metering orifices 132 may fully overlap with the inlet chamber 128, in which case the maximum flow rate through the valve assembly 100 is determined by the flow area of the metering orifices 132. Alternatively, the metering orifices 132 may only partially overlap with the inlet chamber 128 in the fully-open position, in which case the maximum flow rate through the valve assembly 100 is determined by the flow area of the overlapping regions.

In preferred embodiments of the invention, the position of the sleeve insert 116 relative to the valve body 102 can be adjusted, for example when sleeve insert 116 is a screw-fit in the valve body 102. By adjusting the position of the sleeve insert 116 and hence the end-stop surface 118, the maximum flow rate through the valve assembly 100 can be accurately adjusted by setting the sleeve insert 116 to a position where the desired maximum overlap is achieved.

Figure 4:
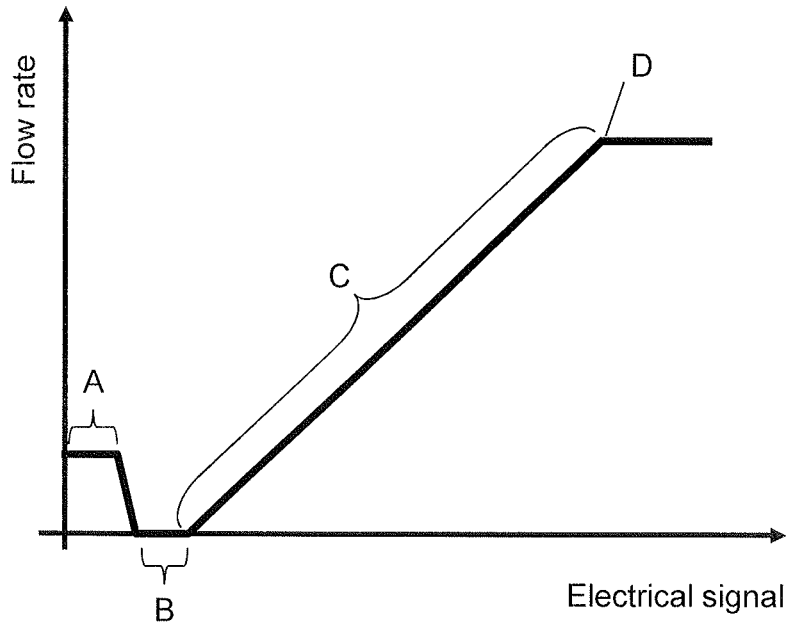
FIG. 4 is a graph illustrating the flow rate through the valve assembly of FIG. 2, as a function of actuation signal.

FIG. 4 illustrates, schematically, how the flow rate through the valve assembly 100 varies as a function of the magnitude of the electrical signal supplied to the actuator.

When the electrical signal is absent (zero) or very small, in the region labelled A in FIG. 4, the valve assembly 100 operates in the first mode of operation illustrated in FIG. 3(*a*), with the valve element 104 in or close to the rest position. A relatively small flow is permitted through the valve assembly 100, via the bypass orifice 134.

At an intermediate electrical signal level, in the region labelled B in FIG. 4, the valve assembly 100 operates in the second mode of operation, illustrated in FIG. 3(*b*). The valve element 104 has now moved away from the rest position, into the closed position with the inlet chamber 128 occluded by the valve element 104, so there is no flow (or only negligible leakage flow) through the valve assembly 100.

At higher electrical signal levels, in the region labelled C in FIG. 4, the valve assembly 100 is in the third mode of operation, in which the metering orifices 132 overlap with the inlet chamber 128. In this mode of operation, the overlap between the metering orifices 132 and the inlet chamber 128 increases as the valve member 104 moves further towards the outlet aperture 136, and accordingly the flow rate through the valve assembly 100 increases with increasing electrical signal level. Although a linear relationship is shown between flow rate and electrical signal in region C of FIG. 4, it will be appreciated that the relationship may not be linear in some embodiments of the invention.

The flow rate through the valve assembly 100 increases with increasing electrical signal until the valve member 104 reaches the fully-open position (when it abuts the end surface 118 of the sleeve insert 116). At this point, labelled D in FIG. 4, the maximum flow rate through the valve assembly 100 is obtained. A further increase of the electrical signal does not result in a further increase of the flow rate.

Figure 1:
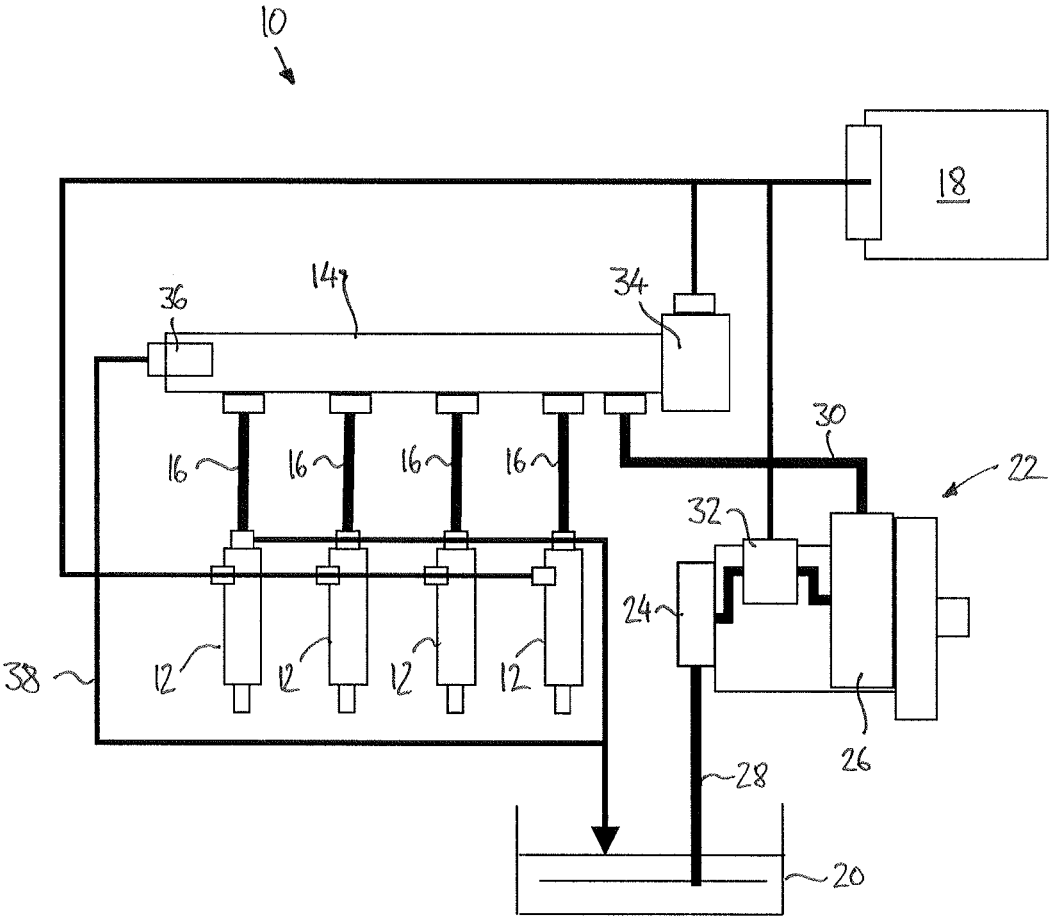
FIG. 1, which has been referred to above, is a schematic diagram of a conventional fuel injection system having a conventional inlet metering valve.
Figure 5:
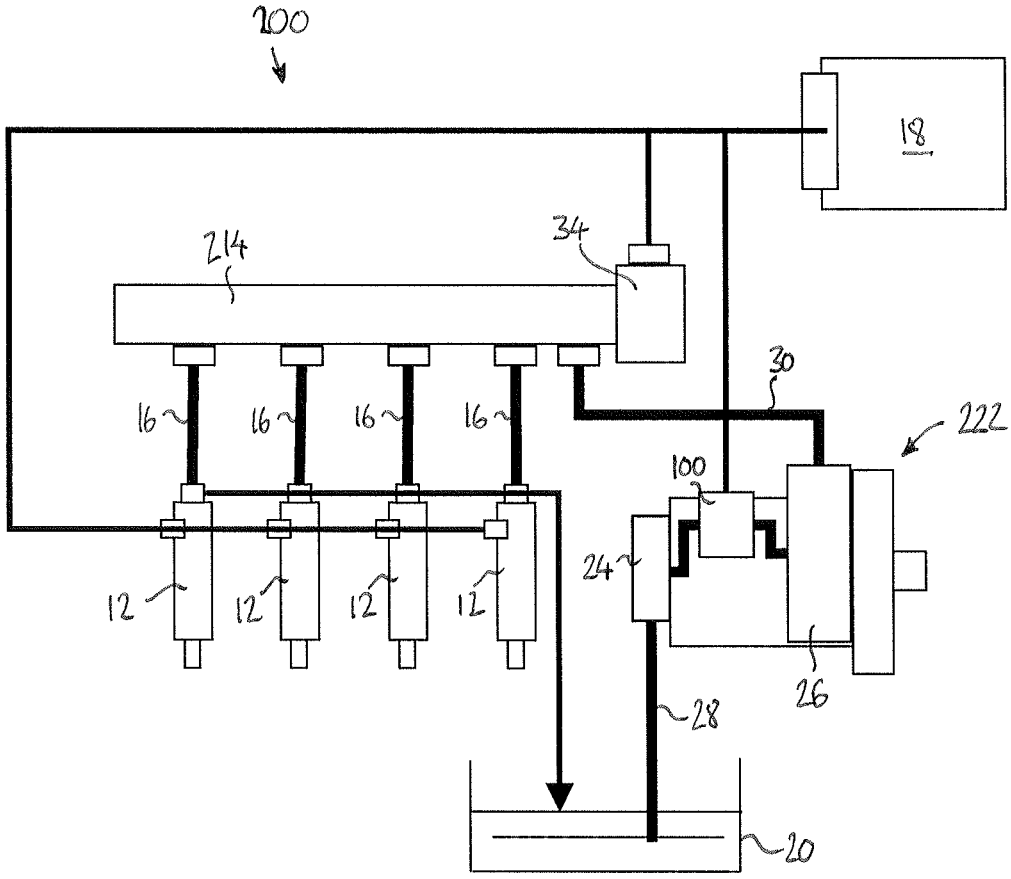
FIG. 5 is a schematic diagram of a fuel injection system having an inlet metering valve comprising the valve assembly of FIG. 2.

A fuel injection system 200 that includes an inlet metering valve comprising a valve assembly of the present invention is illustrated in FIG. 5. The fuel injection system 200 of FIG. 5 is similar to the fuel injection system 10 shown FIG. 1, and like reference numerals are used for like parts in FIGS. 1 and 5. Reference should be made to the description of FIG. 1 for an explanation of any parts not specifically mentioned below with reference to FIG. 5.

In the fuel injection system 200 of FIG. 5, the fuel pump assembly 222 includes an inlet metering valve comprising a valve assembly 100 as described with reference to FIGS. 2 to 4. The inlet passages 126 receive fuel from the transfer pump 24, and the outlet aperture 136 is in communication with the high-pressure pump 26.

By virtue of the first mode of operation described above, the valve assembly 100 advantageously permits fuel flow at a restricted rate, via the bypass orifice 134, when no signal is provided to the actuator. Accordingly, in the event of a failure that results in the absence of a control signal, some fuel can still reach the high-pressure fuel pump 26 to allow operation of the engine, which is an improvement over the inlet metering valve of the normally-closed type known from the prior art.

Also, because the fuel flow through the valve assembly 100 in this first mode of operation is considerably lower than the maximum flow rate possible, as illustrated in FIG. 4, there is a much lower risk of the fuel pressure in the system 200, and in particular in the rail 214, reaching an unacceptably high level in the event of a electrical drive failure. Accordingly, the system 200 does not require a pressure-limiting valve or fuel return line (36, 38 in FIG. 1), representing an advantage compared to a system in which a known inlet metering valve of the normally-open type is used. Furthermore, because a pressure-limiting valve is not required, the design of the fuel rail 214 is simplified and a high-pressure seal between the rail 214 and a pressure-limiting valve need not be accommodated.

By virtue of the second and third modes of operation described above, the valve assembly 100 permits full control of the fuel flow to the high-pressure pump 26 and hence to the fuel rail 214, by the supply of suitable signals to the actuator from the electronic control unit 18. The fuel flow is variable from zero flow when the valve element 104 is in the closed position, to maximum flow when the valve element 104 is in the fully-open position. By setting the valve element 104 into a partially-open position, an intermediate flow can be achieved.

For example, during engine starting, the valve assembly 100 may be set into the fully-open position by applying a large electrical signal, thereby to maximise the flow rate to the high-pressure pump 26. In this way, the fuel pressure in the rail 214 increases to the target level as quickly as possible.

During normal engine operation, the engine control unit 18 drives the valve assembly 100 as appropriate in regions B and C in FIG. 4. In steady-state conditions, the flow rate through the valve assembly 100 can be set to equal the prevailing total flow rate through the injectors 12, plus any internal leakage flows, in order to maintain a steady rail pressure. An increase in the rail pressure can be achieved by moving the valve element 104 towards its fully-open position. A decrease in the rail pressure can be achieved by moving the valve element 104 towards, or into, its closed position.

Although the valve assembly of the present invention has been described with reference to a fuel injection system, the valve assembly is also suitable for use in any application where it is desirable to maintain a restricted flow through a valve when no control signal is supplied, but when variation of the flow through the valve from zero to a maximum flow rate is desired.

It will be appreciated by a person skilled in the art that many other configurations of valve assembly can be contemplated that function in the same way as the embodiment described above.

By way of example, a valve assembly having a valve element arranged for rotary movement could be used. In another example, the bypass and metering orifices may be provided in the valve body, and the inlet passages may be provided in the valve element. The biasing spring may be housed in a different location within the valve assembly, or within the actuator. A further spring may act on the valve element in an opposite direction to the biasing spring, so as to hold the valve element in the rest position when the control signal is absent. In this case the valve element could be moved towards the closed position by application of an actuation force in a first direction, against the action of the further spring, and towards the fully-open position by application of an actuation force in a second direction, against the action of the biasing spring.

It will be understood that many other modifications and variations of the invention not explicitly described above are possible without departing from the scope of the invention as defined in the appended claims.

The invention claimed is:

1. A valve assembly comprising:

a valve body having a bore;

an inlet opening defined in the valve body;

an outlet aperture; and a valve element received in the bore and arranged to control fluid flow between the inlet opening and the outlet aperture, the valve element being moveable linearly between a rest position (A) where it abuts a shoulder and a fully-open position (D) where it abuts an end surface;

wherein the valve element is moveable from the rest position (A) into a closed position (B) on application of a first control signal and towards the fully-open position (D) on application of a second control signal, the magnitude of the second control signal being greater than the magnitude of the first control signal and the valve element is biased to return to the rest position (A) when no control signal is present;

and wherein:

when the valve element is in the rest position (A), fluid flow between the inlet opening and the outlet aperture is permitted at a relatively low rate;

when the valve element is in the closed position (B), fluid flow between the inlet opening and the outlet aperture is substantially prevented; and when the valve element is in the fully-open position, fluid flow between the inlet opening and the outlet aperture is permitted at a relatively high rate, and wherein, the valve element is configured to occlude the inlet opening when in the closed position (B), the valve element further comprising at least one bypass orifice that communicates with the outlet aperture, arranged such that the bypass orifice overlaps with the inlet opening to allow fuel to flow at the relatively low rate when the valve element is in the rest position (A).

2. A valve assembly according to claim 1, wherein the closed position (B) is intermediate the rest position (A) and the fully-open position (D).

3. A valve assembly according to claim 1, wherein the valve element comprises at least one metering orifice that partially or fully overlaps with the inlet opening to allow fuel to flow at the relatively high rate when the valve element is in the fully-open position (D).

4. A valve assembly according to claim 1, further comprising an adjustable stop that defines the relative location of the valve element when in the fully-open position (D), with respect to the valve body.

5. A valve assembly according to claim 1, wherein the valve element is moveable to at least one partially-open position (C) in which fluid flow between the inlet opening and the outlet aperture occurs at a reduced rate compared to the fully-open position (D).

6. A valve assembly according to claim 5, wherein the valve element is moveable to a plurality of partially-open positions (C) between the closed position (B) and the fully open position (D) to selectively vary the fluid flow rate between the inlet opening and the outlet aperture from approximately zero to the relatively high rate, depending on a magnitude of the applied control signal.

7. An inlet metering valve for a fuel injection system, comprising a valve assembly according to claim 1.

8. A fuel injection system for an internal combustion engine, comprising:

metering valve according to claim 7;

a transfer pump for delivering fuel to the inlet opening of the valve assembly;

a high-pressure pump arranged to receive fuel from the outlet aperture of the valve assembly and to deliver the fuel at high pressure to a fuel rail; and an electronic control unit for providing the control signal to the valve assembly.

9. A method for controlling fuel pressure in a fuel injection system of an internal combustion engine, the fuel injection system being as claimed in claim 8 and comprising:

wherein the inlet metering valve is arranged to allow a restricted flow of fuel therethrough when no control signal is provided;

the method comprising:

closing the inlet metering valve when a control signal of relatively low magnitude is provided; and fully opening the inlet metering valve when a control signal of relatively high magnitude is provided.

10. A method according to claim 9, further comprising partially opening the inlet metering valve when a control signal of intermediate magnitude is provided.

* * * * *